US005809568A

United States Patent [19]

Morris-Jones

[11] Patent Number: 5,809,568

[45] Date of Patent: Sep. 22, 1998

[54] DISPOSABLE BIBS

[76] Inventor: Muriel Morris-Jones, 26 Old Gloucester Street, London WC1V 3AJ, United Kingdom

[21] Appl. No.: 808,357

[22] Filed: Feb. 28, 1997

[51] Int. Cl.[6] ..... A41B 13/10

[52] U.S. Cl. ..... 2/49.1; 2/52

[58] Field of Search ..... 2/48, 49.1, 49.4, 2/49.5, 50, 51, 52; 4/243.1, 243.2, 244.2, 245.1, 245.8

[56] References Cited

U.S. PATENT DOCUMENTS

| | | | |
|---|---|---|---|
| 2,552,462 | 5/1951 | Savrin . | |
| 2,621,330 | 12/1952 | Musselwhite . | |
| 2,763,867 | 9/1956 | Chagnon | 2/49.1 |
| 3,299,440 | 1/1967 | Grable . | |
| 3,329,969 | 7/1967 | Farber et al. | 2/49.4 X |
| 3,332,547 | 7/1967 | Rowe et al. . | |
| 3,452,363 | 7/1969 | Shultz | 2/49.1 |
| 3,583,558 | 6/1971 | Davis . | |
| 3,999,221 | 12/1976 | Hannigan | 2/49.1 |
| 4,186,443 | 2/1980 | Britzman . | |
| 4,569,086 | 2/1986 | Takefman . | |
| 4,884,299 | 12/1989 | Rose | 2/49.1 X |
| 5,100,710 | 3/1992 | Rizzuto . | |
| 5,530,968 | 7/1996 | Crockett | 2/48 X |

FOREIGN PATENT DOCUMENTS

| | | |
|---|---|---|
| 107 224 | 5/1984 | European Pat. Off. . |
| 1 217 520 | 12/1970 | United Kingdom . |
| 1215515 | 12/1970 | United Kingdom . |
| 1 258 330 | 12/1971 | United Kingdom . |
| 2 124 888 | 2/1984 | United Kingdom . |
| WO 86/05076 | 9/1986 | WIPO . |

*Primary Examiner*—C. D. Crowder
*Assistant Examiner*—Shirra L. Jenkins
*Attorney, Agent, or Firm*—Everett G. Diederiks, Jr.

[57] ABSTRACT

A disposable bib is formed from two sheets of absorbent material such as tissue paper, separated by perforations. The bibs are dispensed from a roll, with each bib being separated from the roll along a row of perforations. Alternate sheets have a flap defined by perforations. In use the flap is released from one of the sheets and folded to overlie or underlie the other sheet to provide a neck-receiving opening and a double thickness protective bib portion.

16 Claims, 5 Drawing Sheets

FIG. 4
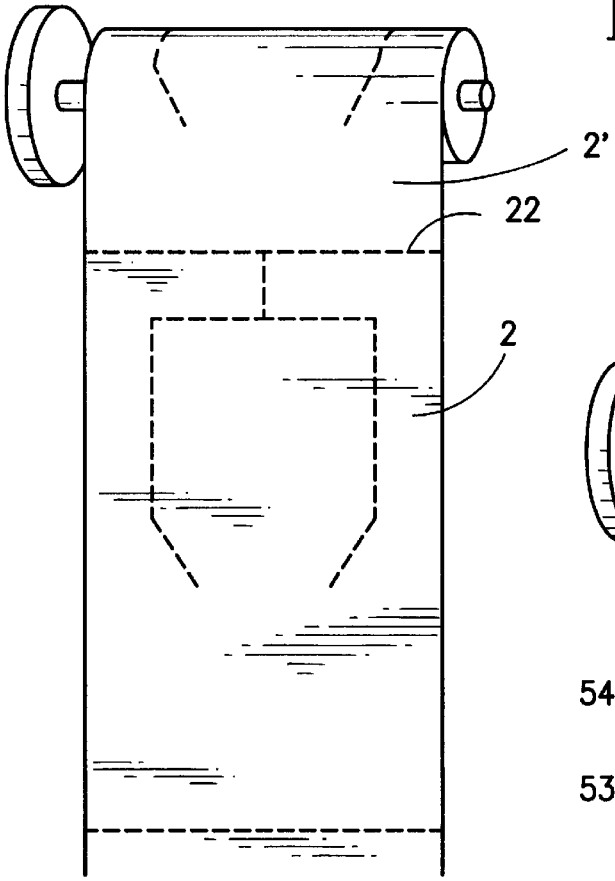
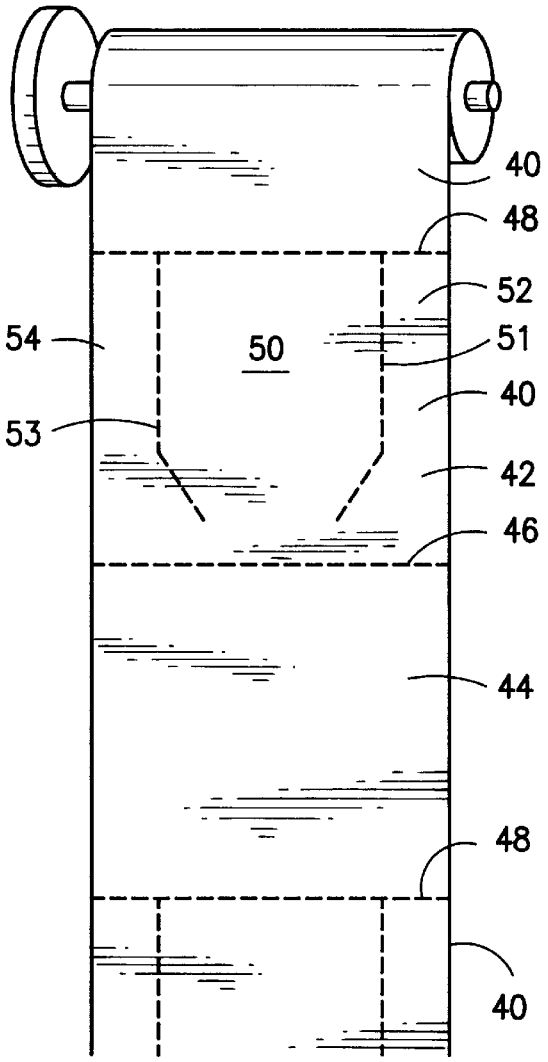
FIG. 6
FIG.5
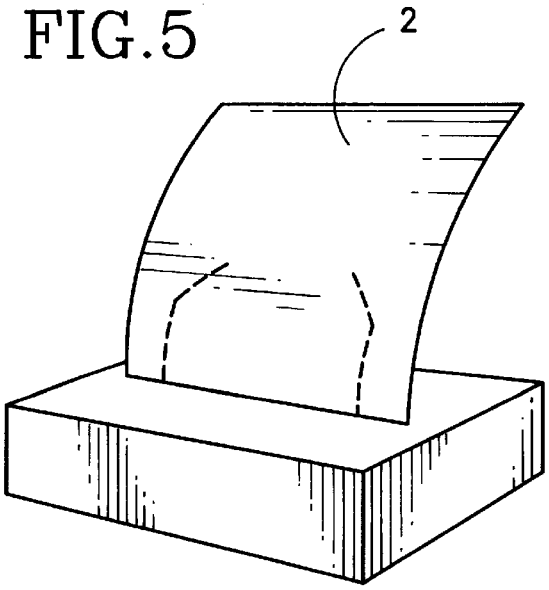

DISPOSABLE BIBS

FIELD OF THE INVENTION

The present invention relates to disposable bibs which may, for example, be used by children or which might also be used by adults for example in restaurants, at parties or barbecues to protect clothing from accidental spillage of food or drink. It is particularly useful in providing a bib which may be used in emergency situations, or in situations where a conventional bib may not be readily available, such as, for example, in a car or at picnics. It may also be usable in hospitals, for example, where disposable products are extremely useful.

BACKGROUND OF THE INVENTION

Disposable bibs are known, for example from WO 86/05076, GB 2124888 and U.S. Pat. No. 5,100,710. These bibs are made from sheet material, in which a neck-receiving hole is produced by tearing away and discarding a portion of the bib. The bib is then placed around the user's neck and secured there.

In order to give sufficient protection to users, the bibs are typically formed from a multi-ply sheet, one of the plies of which is liquid impervious so as to prevent liquid from seeping through the bib onto the user's clothing. Such materials are more expensive than non-impervious materials, and the present invention seeks to provide a bib which may more readily allow the use of such materials.

SUMMARY OF THE INVENTION

It is an object of the invention in one aspect to provide a disposable bib which can afford protection to a wearer by folding a portion of the bib over another portion of the bib to give a double layer of protection.

It is a further object of the invention to provide a multi-purpose disposable bib in the form of two or more sheets which may be separated and used as absorbent wipes or left joined and used as a bib.

It is a further object of the invention to provide a roll or other continuous length of sheets of absorbent material from which sheets can be detached in pairs or in greater numbers to provide a disposable bib, or singly, for example to provide a wipe or the like.

From a first aspect therefore the invention provides a disposable bib comprising means such as perforations or other lines of weakness defining a flap which when released from the bib may be folded to overlie a further portion of the bib to provide a double thickness protective layer.

From a second aspect, the invention provides a disposable bib comprising two sheets of absorbent material detachably joined together about a line of weakness, one of said sheets having a line of weakness for defining, at least partially, a neck opening when broken.

From a further advantageous aspect the invention provides a plurality of sheets of absorbent material detachably joined together along respective lines of weakness, each sheet of the plurality of sheets having one or more lines of weakness for defining a neck receiving opening of a bib when broken, the size of said opening being such that when the bib is being worn by a user, a substantial part of the sheet on which the opening is formed is arranged around the neck and shoulders of the wearer, the arrangement being such that two or more sheets may be removed together from the plurality of sheets for use as a bib, and individual sheets may be removed singly from the plurality of sheets for other uses.

Thus in accordance with this aspect of the invention, the bib has one sheet for receiving the wearer's neck and one or more further sheets to provide protection to a user. The sheet accommodating the neck does not in itself form a complete bib.

In accordance with the first aspect of the invention referred to above, rather than discarding a neck-defining portion as was done previously, it is now folded to overlap the protective portion to give a double thickness protective layer. This may obviate the need for liquid impervious layers to be incorporated in the bib material, thereby reducing costs. Furthermore, it has been found that some people are allergic to backing materials, such as latex, which are used on existing disposable bibs. By choosing material having suitable absorbency, such layers may be dispensed with, thereby avoiding the possibility of an allergic reaction.

Preferably, therefore, the bib is of an absorbent sheet material, such as paper or other cellulosic material. The material may, typically, be multi-ply similar to that used in kitchen towels or in paper handkerchiefs, and can be chosen or manufactured to give a desired absorbency. Other materials such as non-woven materials may also be suitable.

The flap means should, clearly, be of such a size as to allow a user's neck to be received, but also preferably to overlap a substantial portion of the protective portion to give maximum protection. Preferably, therefore, the flap means overlaps at least 50% of the length of the protective portion, when folded into position.

The flap means may be generally rectangular in shape, so that a generally rectangular double protection layer is produced.

The bib is retained around a user's neck by the material surrounding the flap means. Preferably the material is formed into two strips which may be tied or adhered together or otherwise secured around the user's neck.

The strips may be formed so as merely to extend longitudinally to an edge of the bib, or may be configured so as at least partly to extend around the flap means laterally.

Also, to avoid wastage of material during manufacture, the bib itself is preferably rectangular in shape.

As is preferred, the bib may comprise two sheets, for example of the same or similar size, joined along a line of weakness, one sheet defining substantially the protective portion and the other providing the flap means. If it is desired to use the bib simply as a tissue, wipe or cloth, the sheets may be separated along the line of weakness, and used independently.

The flap means may be pre-cut in the material of the bib, so that to use the bib, the user need only fold the flap means into position. Preferably, however, the flap means is at least partially defined by lines of weakness, such as perforations, so that when it is desired to use the bib, the lines of weakness must first be broken by the user so as to liberate the flap means and the flap means then folded into position. Most preferably, the lines of weakness define the lateral portions at least of the flap means. Such arrangements keeps the flap means in position until use and considerably facilitates manufacture and packaging of the bibs.

Preferably the lines of weakness define only a portion of the periphery of the neck receiving opening, so as to leave a web of material to connect the flap means to the protective portion, the web defining the hinge means.

As the sheet material is generally thin and flexible, no scoring or pre-folding of the bib in the region where the flap will be folded will generally be required.

Typically the flap may be defined between longitudinally extending lines of weakness, a folding line extending transversely between the ends thereof.

The ends of the lines of weakness may be formed so as to reduce the risk of tearing of the bib in this region, for example being formed as rounded holes. Alternatively, a strengthening material such as size, starch, acrylic or rubber adhesive may be applied locally in this region to resist tearing.

It is possible that the whole of the flap means may be defined by lines of weakness. For example in the arrangement defined above in which the bib is formed of two separable sheets, the flap may extend down to the line of weakness joining the sheets, so that the line of weakness forms the flap fold line. In such cases, however, the configuration of the respective lines of weakness should preferably be such as to resist detachment of the flap means when it is pulled in the direction perpendicular to its folding line. This may be achieved, for example, by having the respective longitudinal lines of weakness meeting the fold line in a discontinuous manner, for example substantially at right angles to each other. Alternatively, these regions may be strengthened by adhesive or the like, as mentioned in the previous paragraph.

Bibs in accordance with the invention may be supplied to users in a number of ways. Preferably, a plurality of bibs may be supplied joined together, for example as a roll, pad or stack, with successive bibs separated by respective lines of weakness. In another arrangement, however, individual bibs could be stacked in a package, in a manner similar to paper towels or tissues, possibly being interleaved to facilitate their removal. For example, a pocket pack containing a relatively small number of bibs could be provided for portable use, for example for carrying in pockets or handbags.

The invention therefore also provides a roll stack, pad or the like of bibs in accordance with the invention joined together along respective lines of weakness, and to a package containing a stack of bibs in accordance with the invention.

As mentioned above, each bib is preferably formed from two sheets joined at a line of weakness, to allow individual sheets to be removed for other purposes, for example wiping up spillages etc. From a further aspect, therefore, the invention provides a plurality of disposable bibs releasably joined together, each bib comprising two sheets separated by a line of weakness, one of said sheets of each bib having means for defining a neck receiving opening and the other of said sheets of each bib providing in use a protective portion.

Whereas just one sheet of each pair may be formed with the means to define a neck-receiving opening, it is possible, and indeed preferable to form such means on both sheets of each pair. Thus in its most preferred embodiment, the invention provides a plurality of sheets of absorbent material detachably joined together along respective lines of weakness, each sheet of the plurality of sheets having one or more lines of weakness for defining a neck receiving opening of a bib when broken.

With this arrangement, two or more sheets may be removed together for use as a bib, and any number of sheets may be removed singly or together for other uses, for example a wipe, cloth or tissue.

Thus, for example if a wearer is seated and requires protection over his or her lap, more than two sheets may be removed together to provide a bib of sufficient length to extend over the lap. Similarly, if a user wishes to wipe up a large spillage, they may also remove two or more sheets together for use as a wipe. It will be appreciated that when, as is preferred, each sheet has a neck receiving opening, a bib may always be obtained by removing just two sheets, regardless of the order in which wipes and bibs have been used previously.

The size of the neck receiving opening formed in each sheet will preferably be such that when being worn, the sheet on which that opening is provide will be arranged substantially around the neck of the wearer, with the other sheet protecting the body of the wearer.

The configuration of the means defining the neck receiving opening may be different from sheet to sheet, to accommodate different users, for example adults or children. This is itself a new arrangement, and from a further aspect therefore, the invention provides a plurality of disposable bibs releasably joined together, each bib comprising two sheets separated by a line of weakness and having means defining a neck receiving opening in each sheet, the said means on adjacent sheets being configured differently.

It will be appreciated that various advantages of the invention will be realised not only where the neck receiving opening is defined as a folding flap, but also where it is defined by a completely removable portion of the sheet, as described in the prior art documents discussed above. Accordingly, where a bib in accordance with the invention is formed from two sheets detachably joined together, the neck receiving opening can be formed by a completely removable portion of one sheet.

Other features and advantages of the invention will become apparent from the following description and accompanying drawings which describe various preferred embodiments of the invention.

BRIEF DESCRIPTION OF THE DRAWINGS

FIG. 4 shows a first method of dispensing bibs in accordance with the invention;

FIG. 5 shows a second method of dispensing bibs;

FIG. 6 shows a further embodiment of the invention;

DESCRIPTION OF THE PREFERRED EMBODIMENT

With reference to the Figures, a disposable bib 2 is made from absorbent sheet material. In particular, the sheet material is a multi-ply paper sheet, having for example two or three plies, of a type used in paper towels or handkerchiefs.

Figure 1:
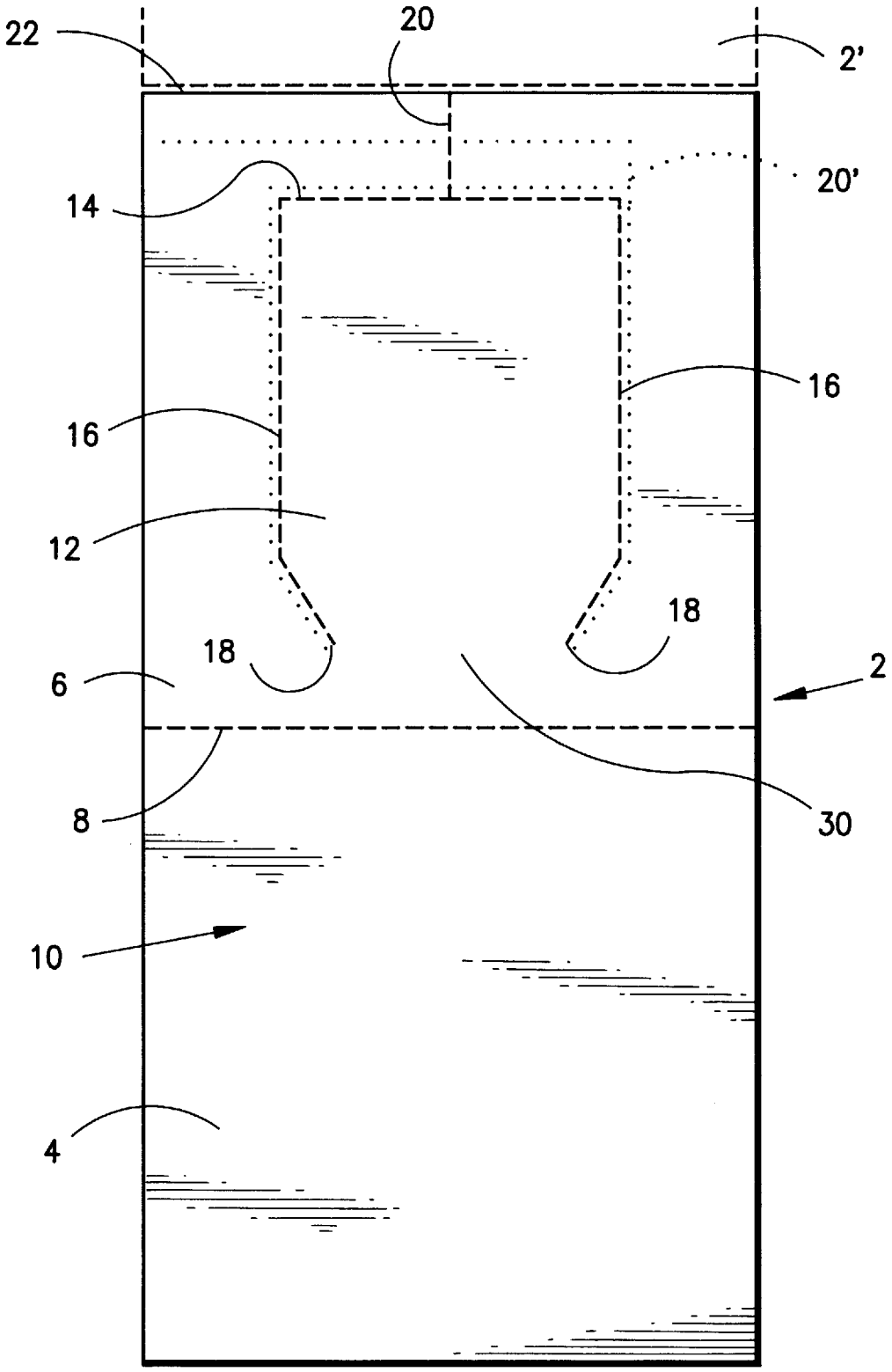
FIG. 1 shows a bib in accordance with the invention before use.

The bib has two sheets 4,6 of generally equal size joined along a line of perforations 8. The lower (in the sense of FIG. 1) sheet 4 substantially defines a protective portion 10 which in use lies over the chest or upper body of a wearer.

The upper sheet 6 is provided with generally rectangular flap means 12 defined by a transversely extending upper line of perforations 14 and two longitudinally extending lines of perforations 16. The longitudinally extending lines of perforations 16 each terminate at an end point 18 short of the line of perforations 8. The protective portion 10 extends below the end points 18. A yet further line of perforations 20 extends centrally longitudinally upwardly from the upper line of perforations 14 to the top edge 22 of the bib 2.

Figure 3:
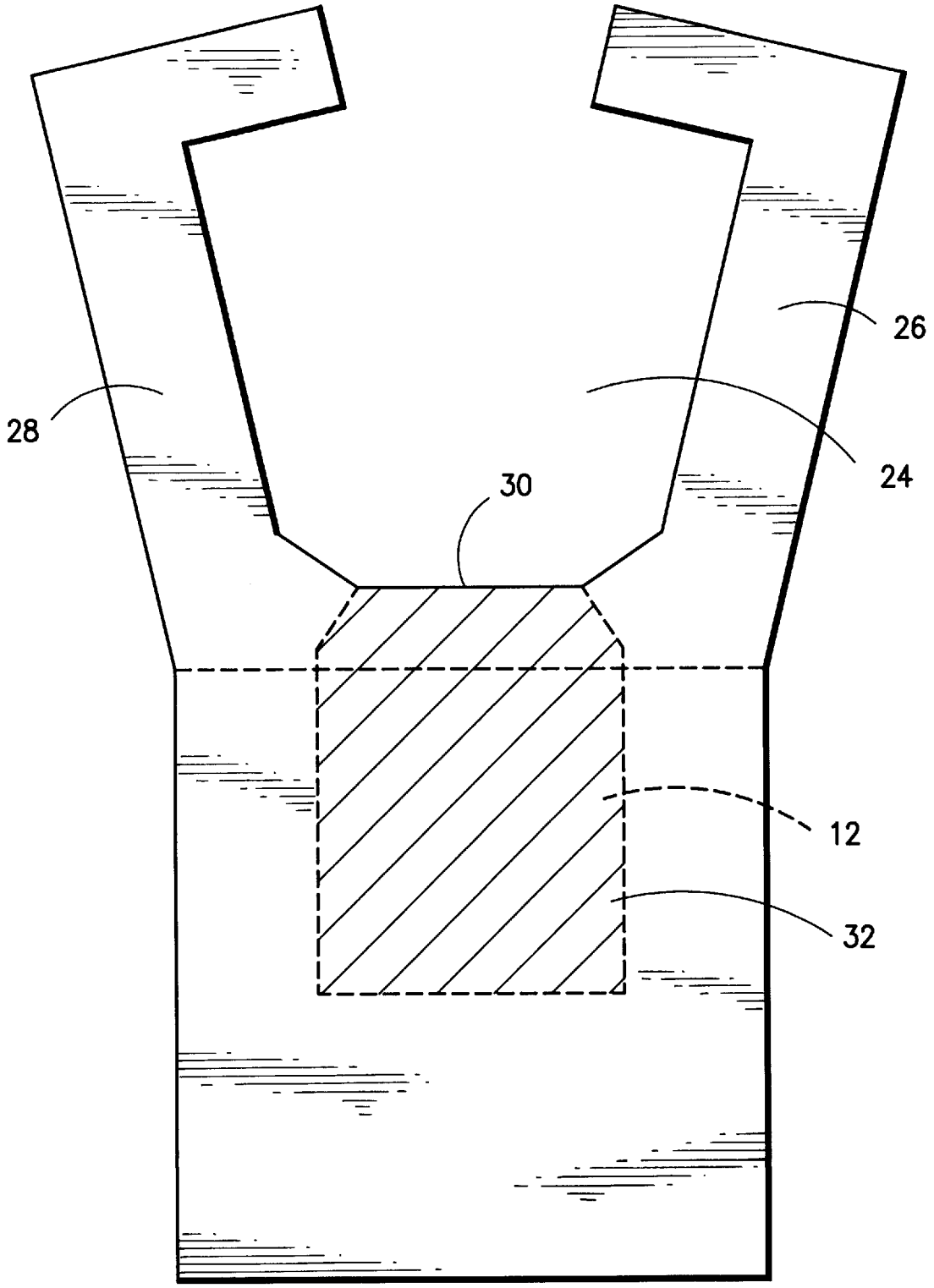
FIG. 3 shows the bib of FIG. 1 ready for use.

The web of material 30 extending between the perforation end points 18 defines a fold line around which the flap 12 may be folded, as shown in FIG. 3, into a position in which it overlaps the protective portion 10 of the bib 2 to give a double thickness area 32, shown shaded in FIG. 3.

FIG. 3 shows the bib from the front, and it is preferred to place the flap 12 under the sheet 4 to prevent it being damaged by a wearer, such as a child, during use.

To use the bib 2, a user tears the perforations 20, and then continues to tear the perforations 14,16 up to their end points 18 so as to liberate the flap 12 (see FIG. 2) and define a neck receiving opening 24. The material around the flap forms two strips 26,28 which, are used to retain the bib 2 on the user.

Figure 2:
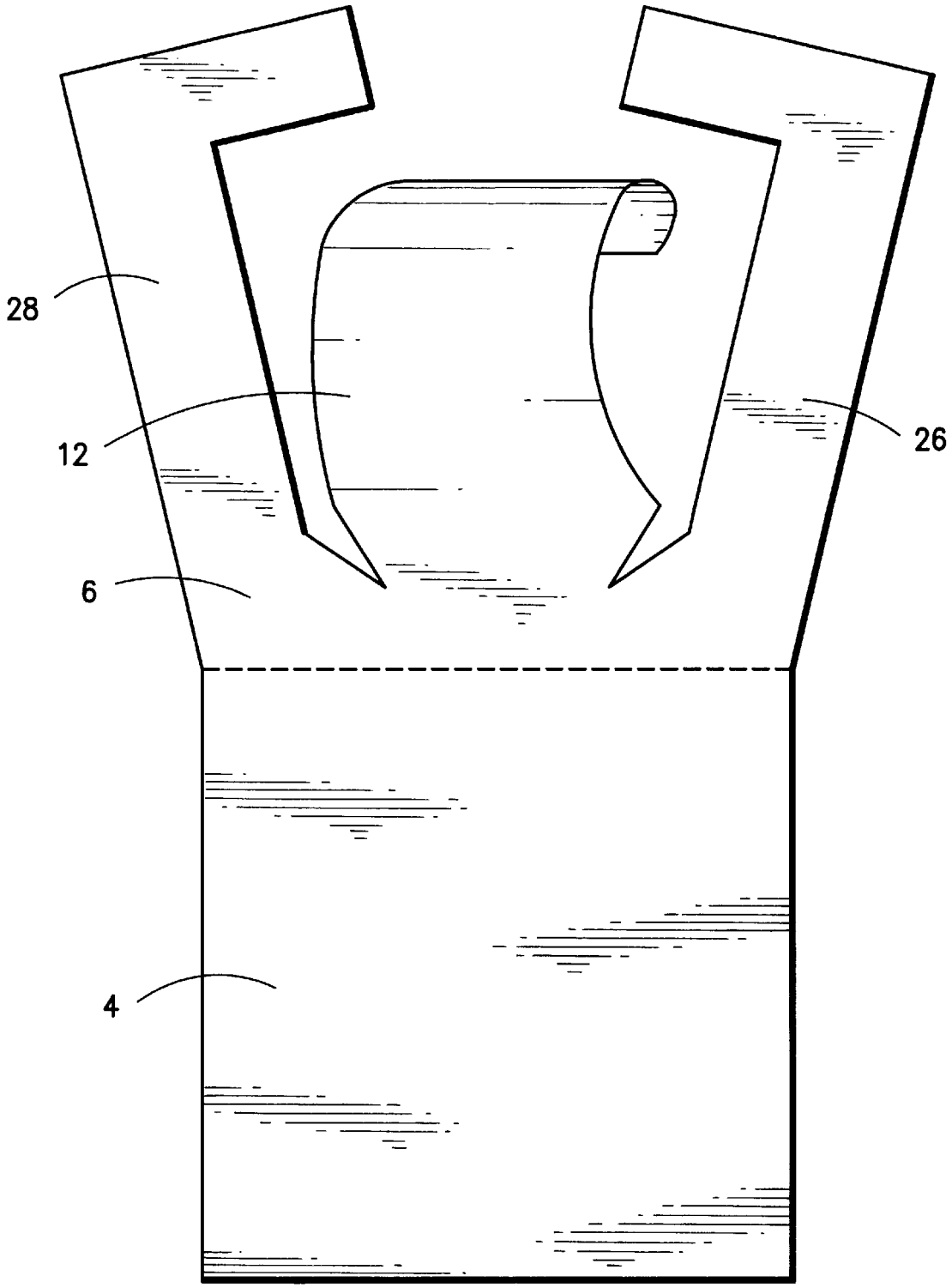
FIG. 2 shows the bib of FIG. 1 in an intermediate position.

In particular, the retaining strips 26,28 are pulled apart as shown in FIGS. 2 and 3 to allow the bib to be placed around the neck of a user, whereupon they may be tied or otherwise secured together to keep the bib in place. For example, areas of contact adhesive may be placed on opposed surfaces of the strips to allow them to be held together. Alternatively, the strips may simply be secured to a wearers' garments, for example by being tucked down the neck of a shirt, pullover or the like.

Low-tack adhesive could be provided on all or selected areas of the bib to facilitate its positioning on a user and also to retain the flap in position.

It will be seen that the embodiment described provides a large area 32 of double thickness protection, in the central area which is most likely to be subjected to spillages. The absorbency of the material is chosen so as to give good protection under normal circumstances, although if it is anticipated that there may be heavy spillages, two or more bibs may be worn one over the other.

The bib may be used simply as a cloth for mopping up spillages, for example and if desired, two cloths may be provided from a single bib by tearing the bib along the perforations 8. Thus the invention at least in its preferred embodiment provides an inexpensive and versatile disposable bib.

The bib 2 may be dispensed from a roll or pad of joined bibs, the bib 2 being torn away from the next bib (2' FIG. 1) along a perforated upper edge 22 as shown schematically in FIG. 4. Alternatively individual bibs may be stacked one above the other in a box or package, in a manner similar to paper tissues or napkins, as shown in FIG. 5.

FIG. 6 shows a further embodiment of the invention. This embodiment is generally similar to that shown in FIG. 4, but in this embodiment, each bib 40 is formed from two sheets 42,44 separated by perforations 46. Respective bibs 40 are separated by perforations 48. The flap 50 is defined by rows of perforations 51,53 which extend to the perforations 48 to define the retaining strips 52,54. Each sheet 42,44 may be used separately as a wipe, for example, but to use a bib, both sheets are detached from the next bib in the roll, the perforations 51,53 broken and the strips 52,54 then secured in position around a user's neck as required.

Figure 7:
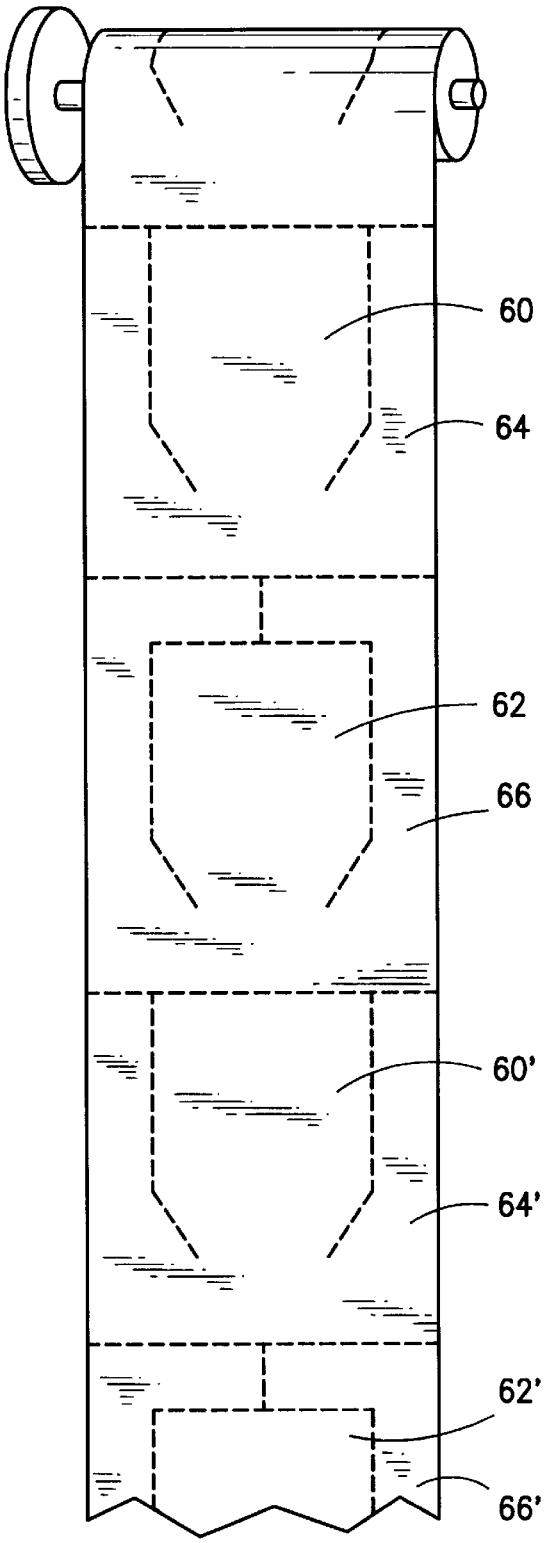
FIG. 7 shows a yet further embodiment of the invention.

FIG. 7 shows a yet further embodiment. This is similar to the embodiment of FIG. 6, except that different sized flaps 60,62,60',62' are formed on adjacent successive sheets 64,66,64',66'. This will allow a bib to be separated from a roll with an appropriately shaped and sized flap for a user. Furthermore, individual sheets may be removed from the roll for use as wipes.

Figure 8:
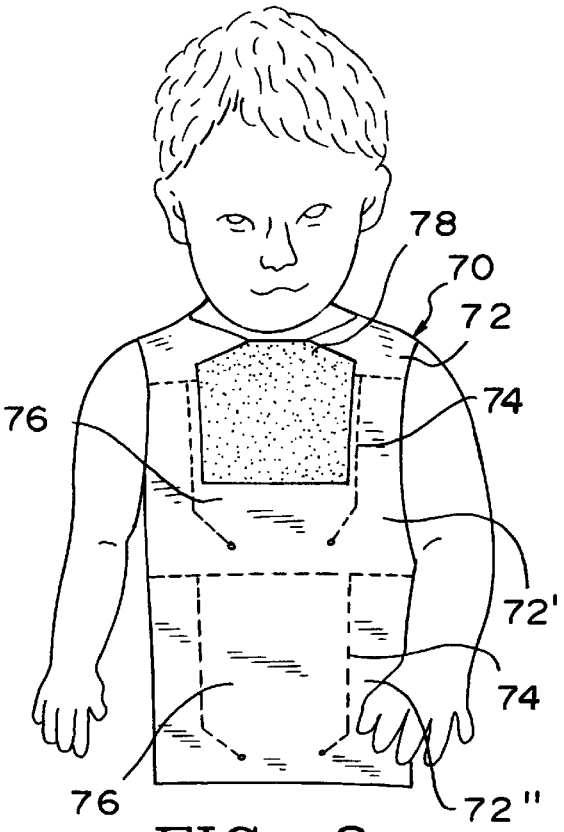
FIG. 8 shows a yet further embodiment of the invention.

FIG. 8 shows a yet further embodiment in position around the neck of a child. Here the bib 70 comprises three sheets 72, 72', 72" of paper material which have been removed from the end of a roll of sheets. Each sheet is substantially identical, and each has perforations 74 defining flaps 76 which, when released, will define neck openings. The flap 76 has been released from the uppermost sheet 72 and folded over the sheet 72' below it to form a double thickness protective portion 78 in the region where most spillages are likely to occur. However, the lowermost sheet 72" will also give some protection to the lower trunk and lap of the child. It will be seen that as the flap 76 takes up a substantial portion of each sheet, the uppermost sheet 72 is arranged substantially around the neck and shoulders of the wearer. Also, as similar flaps are provided on each sheet, no matter how many are removed for use as bibs or wipes, a user will still be able to detach the next two or more sheets on the roll to provide a bib.

Various modifications to the described embodiments fall within the scope of the invention. For example, the flaps may have different shapes, and may even extend down to the line of perforations separating the two sheets of a bib, which can then act as a fold line about which the flap may be folded. The orientation of the perforations transversely across the bib, will act to resist detachment of the flap if it is pulled downwardly as it is being folded into its operative position.

Further, the retaining strips 24,26 may be configured differently. In one embodiment, for example, the perforations 20 may be replaced by perforations 20' shown in circle dots in FIG. 1 whereby their length may be increased to facilitate tying around the neck. Furthermore, the corners of the flap 12 may be rounded to reduce the risk of the strips 24,26 ripping in these areas, or local strengthening may be applied in these areas. Also, strengthening in the form of size, adhesive or the like may be applied locally in other regions where tearing is not desired, such as at the ends of the strips 24,26.

Also, whilst the neck openings in certain embodiments have been shown as being defined by flaps which can be folded over to form a double protective layer, the neck receiving hole could be defined by a completely removable flap which is then discarded. This is not preferred, however, as it may be necessary then to provide a heavier weight of bib material to provide adequate protection.

Whilst a bib embodying the invention has been exemplified in FIG. 8 as worn by a child, it will be appreciated that the invention can equally be applied to adults, and the neck openings can be sized accordingly.

It will also be appreciated that the lines of weakness referred to above may comprise perforations, roulette cuts, and so on and the term is not intended to be limited solely to perforations.

I claim:

1. A disposable bib comprising: first and second sheets of absorbent material detachably joined together about a first line of weakness, said first sheet having a second line of weakness for defining, at least partially, a flap, wherein the flap may be folded upon breaking the second line of weakness to create a neck receiving opening in said first sheet with said flap being of sufficient length as to overlie said second sheet of said bib to provide a double thickness protective bib portion.

2. A disposable bib as claimed in claim 1, wherein said bib is made of an absorbent paper or cellulosic sheet material.

3. A disposable bib as claimed in claim 1, wherein both of said first and second sheets have a respective said second line of weakness.

4. A package containing a plurality of bibs as claimed in claim 1 arranged in an interleaved stack.

5. A plurality of sheets of absorbent material detachably joined together along respective lines of weakness, each sheet of the plurality of sheets having one or more lines of weakness for defining a neck receiving opening of a bib when broken, the size of said opening being such that when the bib is being worn by a user, substantially the entire sheet on which the opening is formed is arranged around the neck and shoulders of the user with the entire sheet on which the opening is formed having an associated length which would not extend sufficiently below the neck and shoulder of the user to constitute a bib alone, but wherein two or more sheets may be removed together from the plurality of sheets for use as a bib, and sheets may be removed singly or together from the plurality of sheets for other uses.

6. A plurality of sheets as claimed in claim 5, wherein said one or more lines of weakness define a flap which may be folded over a portion of an adjacent sheet to provide a double thickness protective portion.

7. A plurality of sheets of absorbent material detachably joined together along respective lines of weakness, with adjacent pairs of joined sheets forming respective disposable bibs each having a first sheet and a second sheet detachably joined together about a first line of weakness, said first sheet having a second line of weakness for defining, at least partially, a flap having a sufficient length such that breaking the second line of weakness, the flap may be folded so as to overlie said second sheet of said bib, thereby forming a neck receiving opening in said first sheet and providing a double thickness protective bib portion, said sheets being detachable as a pair from a remainder of the plurality of sheets when it is desired to form a bib and in a group of a selected number of the sheets for other purposes.

8. A plurality of sheets as claimed in claim 7, wherein a respective said second line of weakness is provided on alternate sheets of said plurality of sheets.

9. A plurality of sheets as claimed in claim 7,wherein a respective said second line of weakness is provided on every sheet of said plurality of sheets.

10. A plurality of sheets as claimed in claim 9, wherein said second lines of weakness are configured differently on adjacent sheets.

11. A plurality of sheets as claimed in claim 7, wherein each sheet is substantially the same size.

12. A plurality of sheets as claimed in claim 7, wherein said second line of weakness extends longitudinally of said first sheet to define said flap.

13. A plurality of sheets as claimed in claim 7, wherein at least one of the second lines of weakness is formed so as to reduce the risk of tearing of the bib in this region.

14. A plurality of sheets as claimed in claim 7, wherein a region of said first sheet, adjacent ends of said second line of weakness, is strengthened.

15. A plurality of sheets as claimed in claim 14, wherein a strengthening material is applied locally to said region.

16. A plurality of sheets as claimed in claim 7, wherein the plurality of sheets are arranged in a roll.

* * * * *